US010670035B2

(12) United States Patent
Groppo et al.

(10) Patent No.: US 10,670,035 B2
(45) Date of Patent: Jun. 2, 2020

(54) IMPELLER ASSEMBLY FOR CENTRIFUGAL PUMPS

(71) Applicant: Ebara Corporation, Tokyo (JP)

(72) Inventors: Renato Groppo, Cles (IT); Mariano Matteazzi, Cles (IT); Dai Sakihama, Tokyo (JP); Fabio Balbo, Cles (IT)

(73) Assignee: Ebara Corporation, Tokyo (JP)

( * ) Notice: Subject to any disclaimer, the term of this patent is extended or adjusted under 35 U.S.C. 154(b) by 216 days.

(21) Appl. No.: 15/569,806

(22) PCT Filed: Apr. 27, 2016

(86) PCT No.: PCT/JP2016/063795
§ 371 (c)(1),
(2) Date: Oct. 27, 2017

(87) PCT Pub. No.: WO2016/178434
PCT Pub. Date: Nov. 10, 2016

(65) Prior Publication Data

US 2018/0128281 A1 May 10, 2018

(30) Foreign Application Priority Data

May 4, 2015 (IT) ..... 102015000013754

(51) Int. Cl.
*F04D 29/22* (2006.01)
*F04D 29/24* (2006.01)

(52) U.S. Cl.
CPC ..... *F04D 29/2216* (2013.01); *F04D 29/2266* (2013.01); *F04D 29/245* (2013.01)

(58) Field of Classification Search
CPC ..... F04D 29/2211; F04D 29/2216; F04D 29/2255; F04D 29/2266; F04D 29/245; F04D 29/041; F04D 29/042; F04D 29/167
See application file for complete search history.

(56) References Cited

U.S. PATENT DOCUMENTS 3,246,605 A * 4/1966 Fisher ..... F04D 29/242 415/90
3,487,786 A * 1/1970 Danner ..... F04D 29/0416 415/107

(Continued)

FOREIGN PATENT DOCUMENTS

CN 1209194 A 2/1999
CN 201650848 U 11/2010

(Continued)

OTHER PUBLICATIONS

European Patent Office, Extended European Search Report in European Application No. 16789570.5 (dated Nov. 30, 2018).

(Continued)

*Primary Examiner* — Brian P Wolcott
(74) *Attorney, Agent, or Firm* — Leydig, Voit & Mayer, Ltd.

(57) ABSTRACT

The present invention relates to an impeller assembly for centrifugal pumps, comprising a first disk-like element, operatively arranged towards a coaxial inlet, facing a second disk-like element with a smaller diameter, operatively arranged towards the outlet; this second disk-like element is rigidly connected to the first disk-like element through a set of angularly spaced blades, and is centrally provided with fastening means for fastening to a drive shaft. The distinctive feature of the present invention is that the blades comprise appendices, in flat sheet form, adjacent to the second disk-like element, which are essentially located in correspondence with areas subject to lesser axial thrust.

10 Claims, 4 Drawing Sheets

(56) References Cited

U.S. PATENT DOCUMENTS

| | | | | | |
|---|---|---|---|---|---|
| 3,746,465 | A * | 7/1973 | Van Doorn | F04D 23/003 | 415/206 |
| 3,984,193 | A * | 10/1976 | Yu | F01D 5/048 | 415/228 |
| 4,904,159 | A * | 2/1990 | Wickoren | F04D 7/045 | 415/121.1 |
| 5,171,128 | A * | 12/1992 | Williamson | F04D 29/282 | 416/181 |
| 5,605,444 | A | 2/1997 | Paton et al. | | |
| 6,171,078 | B1 * | 1/2001 | Schob | F04D 13/0646 | 417/420 |
| 2009/0016895 | A1 | 1/2009 | Beez et al. | | |
| 2010/0226773 | A1 | 9/2010 | Bruhn et al. | | |
| 2011/0182748 | A1 * | 7/2011 | Kwok | F04D 29/023 | 416/241 R |

FOREIGN PATENT DOCUMENTS

| | | | |
|---|---|---|---|
| CN | 203308780 | U | 11/2013 |
| CN | 203627296 | U | 6/2014 |
| JP | 2-161200 | A | 6/1990 |
| JP | 2009167990 | A | 7/2009 |
| SU | 754117 | A1 | 8/1980 |
| WO | WO 2014/096604 | A1 | 6/2014 |
| WO | WO 2016/060221 | A1 | 4/2016 |
| WO | WO 2016/153068 | A1 | 9/2016 |

OTHER PUBLICATIONS

Japanese Patent Office, International Search Report in International Application No. PCT/JP2016/063795 (dated Aug. 8, 2016).

* cited by examiner

IMPELLER ASSEMBLY FOR CENTRIFUGAL PUMPS

CROSS-REFERENCE TO RELATED APPLICATIONS

This patent application is the U.S. national phase of International Application No. PCT/JP2016/063795, filed Apr. 27, 2016, which claims the benefit of Italian Patent Application No. 102015000013754, filed on May 4, 2015, which is incorporated by reference in their entireties herein.

TECHNICAL FIELD

The present invention relates to an impeller assembly for centrifugal pumps, of a single or multi-stage type.

BACKGROUND ART

As known, centrifugal pump impellers are generally composed of pairs of disc-like bodies, suitably shaped, facing each other in such a way as to form a cavity within which is located a set of blades connecting the two discs.

Each impeller is also provided with a central hub, or an equivalent coupling device, which allows to fasten the impeller to a shaft brought into rotation by motor means.

SUMMARY OF THE INVENTION

Technical Problem

Most common types of impellers, despite being widely used, have some drawbacks; perhaps, the most important of these is related to axial thrust generation.

A centrifugal pump impeller is in fact subjected to different pressures acting on both sides: on the suction side, generally acts a pressure lower than the atmospheric pressure, while on the opposite side, acts a pressure almost equal to the delivery pressure.

This gives rise to an axial thrust which may become very strong, such as to create large losses, in terms of efficiency, and such as to create overloading that damages the motor bearings.

These critical issues are clearly emphasized in the case of multi-stage pumps.

In an attempt to solve the problems related to the axial thrust generation, some multistage pumps manufacturers connect half of the impellers in the opposite direction of the remaining ones.

However, this solution creates serious difficulties to realize inner flow channels.

The prior art also comprises the impeller assembly, in particular for centrifugal pumps, disclosed in the Italian Patent Application No. VI2014A000271 which allows to solve the above problems effectively. However, the impeller must have a disk with a specific and correct angular position with respect of the other disk and with respect to blades. This implies, in manufacturing the impeller assembly, the use of particular devices that may extend the manufacturing time and affect the final costs of the product.

Substantially, the same applies also for the impeller disclosed in the Italian Patent Application No. VI2015A000081. Also in this case, in fact, it is provided the use of a disk with particular shapes, which shall be precisely positioned with respect to the other disk, and with respect to blades.

CN201650848 discloses an impeller for a submersible pump for a well, wherein a flow channel for water to flow through is arranged between the front cover plate and the rear cover plate, the front cover plate and the rear cover plate are both made of plastics, and the diameter of the rear cover plate is smaller than that of the front cover plate.

U.S. Pat. No. 5,171,128 discloses a centrifugal fan wheel adapted to receive a flow medium for radially accelerated discharge by plurality radially extending impeller blades. A plurality of flow medium passage channels are positioned radially inwardly of an outer extent of the fan wheel to improve the efficiency of the fan. The flow medium passage channels are defined by alternating cutouts disposed between adjacent blades about the outer extent of a fan wheel back plate.

Solution to the Problem

The aim of the present invention is to solve the above-mentioned problems, by realizing an impelling structure, particularly for centrifugal pumps, which allows to reduce the axial thrusts while maintaining maximum efficiency, and made of disc-like elements that can be easily assembled, with no special precautions.

Within the above aim, a further object of the invention is to realize an impeller assembly in which the two disc-like elements do not need to have a specific mutual angular position.

A further object of the present invention is to realize an impeller assembly which solves the problems linked to the traction that is generated on the transmission shaft.

Still a further object of the present invention is to realize an impeller assembly wherein the motor bearings are preserved.

A further object of the present invention is to provide an impeller assembly, which can be manufactured with a low number of components and which is therefore also advantageous from a purely economic viewpoint.

The above aim and objects, and others which will become apparent hereinafter, are achieved by an impeller assembly for centrifugal pumps, comprising a first disk-like element, operatively arranged towards a coaxial inlet of a pump and facing a second disk-like element with a smaller diameter, operatively arranged towards the delivery of said pump; said second disc-like element being rigidly connected to said first disk-like element through a set of angularly spaced blades, and being centrally provided with fastening means for fastening to a drive shaft; the impeller assembly being characterized in that said blades comprise appendices, in flat sheet form, adjacent to said second disk-like element; said appendices being essentially located at areas subject to lesser axial thrust.

The present invention also relates to a centrifugal pump comprising a substantially hollow body which accommodates at least one impeller assembly fastened to a transmission shaft which is rotatable about a rotation axis; said transmission shaft being rotated by motor means; said impeller assembly comprising a first disk-like element, operatively arranged towards a coaxial inlet of said pump and facing a second disk-like element with a smaller diameter, operatively arranged towards the delivery of said pump; said second disc-like element being rigidly connected to said first disk-like element through a set of angularly spaced blades, and being centrally provided with fastening means for fastening to said drive shaft; said centrifugal pump being characterized in that said blades comprise appendices, in flat sheet form, adjacent to said second disk-like element; said appendices being essentially located at areas subject to lesser axial thrust.

Advantageous Effects of the Invention

The impeller assembly according to the invention considerably reduces the axial thrusts and at the same time ensures maximum efficiency and prevalence.

This is achieved by covering with the appendices only the areas subject to lesser axial thrust, relative to the circular crown coplanar to the second disk-like element, and corresponding to circumferences with diameters respectively coincident with those of the two disk-like elements.

By making the appendices in a single piece with the impeller blades, the two disk-like elements need not to be installed in precise reciprocal angular positions.

This allows to simplify and speed up the manufacturing of the impeller assembly, making it clearly more advantageous also from a merely economical point of view.

BRIEF DESCRIPTION OF THE DRAWINGS

Further features and advantages will become apparent from the detailed description of the preferred embodiments of an impeller assembly according to the invention, illustrated in the attached drawings, where.

DESCRIPTION OF THE EMBODIMENTS

Figure 1:
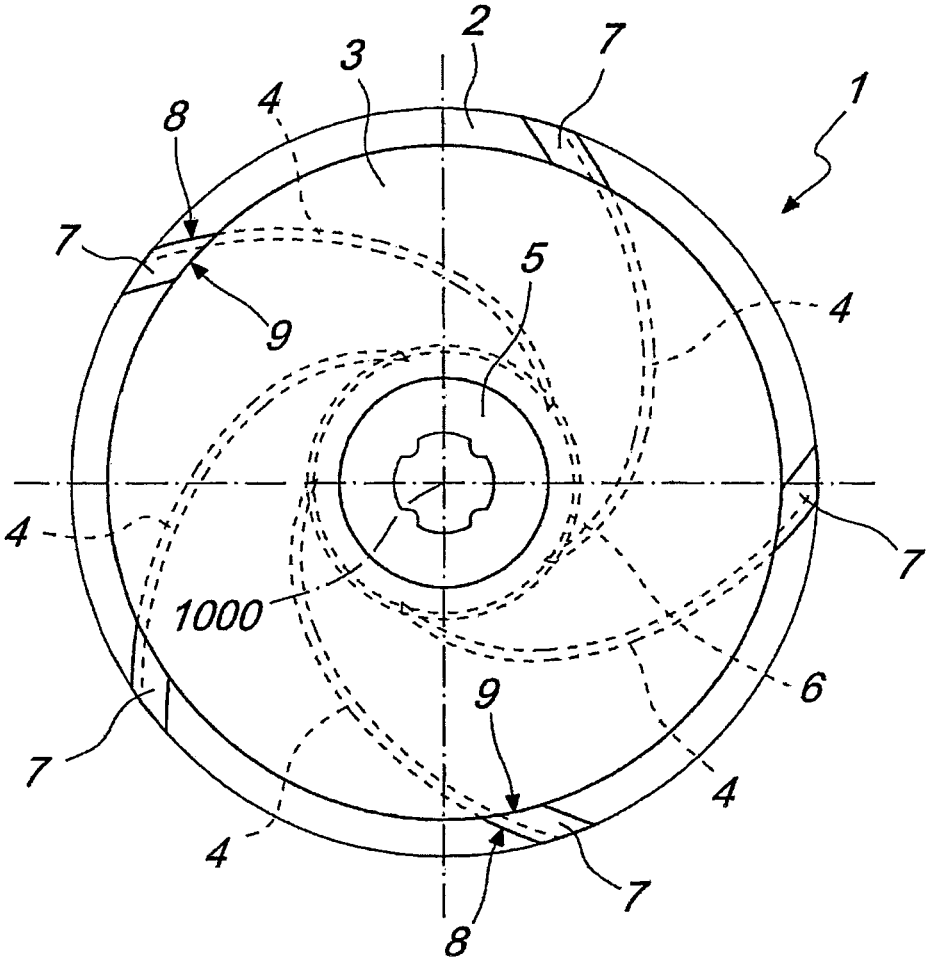
FIG. 1 is a front view of an impeller assembly according to the invention.
Figure 2:
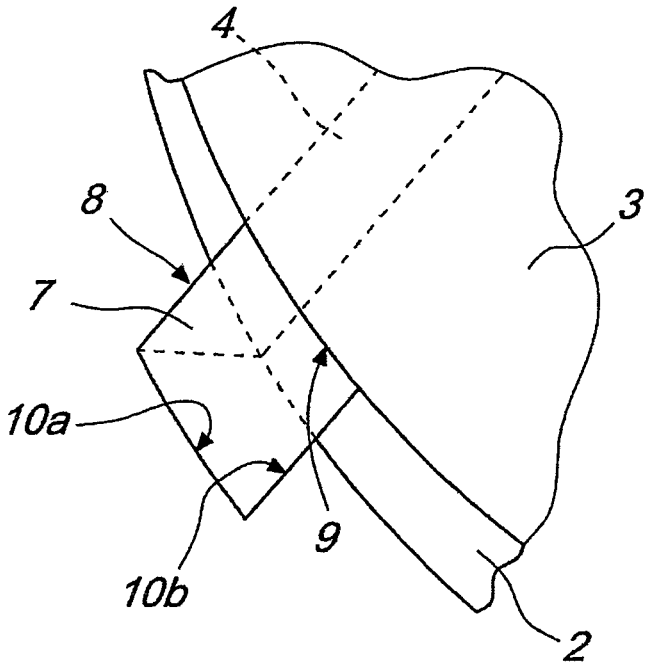
FIG. 2 is an enlarged perspective view of a detail of the impeller assembly of the previous figure.

With reference to FIGS. 1 and 2, an impeller assembly for centrifugal pumps, according to the invention, is generally indicated with the reference number 1.

The impeller assembly 1 is designed for a multi-stage centrifugal pump; however, it is evident for any person skilled in the art that the impeller assembly of the present invention is also suitable for other types of pumps.

The multistage centrifugal pump, which is per se known and is not shown in the figures, comprises a substantially hollow body which accommodates in its interior a set of impellers, made according to the present invention, and coaxially mounted on a drive shaft rotating by motor means.

The impeller assembly 1 comprises a first disk-like element 2, operatively arranged at the pump inlet side, and a second disk-shaped element 3, operatively arranged at the pump delivery side.

The diameter of the second disk-like element 3 is smaller than the diameter of the first disk-like element 2.

The two disc-like elements 2 and 3 are coaxial to a rotation axis 1000, and are facing each other in such a way as to form a cavity of a substantially cylindrical shape.

Blades 4 are arranged inside the cavity. Each blade 4 is substantially flat and oblong and rigidly connects the first disk-like element 2 to the second disk-like element 3.

The blades 4 are angularly distributed around the rotation axis 1000, extending from the center to the peripheral area of the two disk-like elements 2 and 3.

The blades 4 are arranged following a substantially spiral arcuate profile, without jutting out the first disk-like element 2, in such a way as to form radially arranged divergent ducts.

Advantageously, the second disk-like element 3 is provided with fastening means to a drive shaft, not shown in the figures, which is rotatable about the rotation axis 1000.

In the illustrated example, the fastening means are essentially constituted by a hub 5 in the middle of the second disk-like element 3.

Opposed to hub 5, a through hole 6 is centrally formed on the first disk-like element 2 and has a larger diameter than that of the drive shaft.

The through hole 6 in fact constitutes the suction inlet of the impeller assembly 1.

According to the present invention, each blade 4 comprises an appendix 7, in flat sheet form, placed at its edges.

Advantageously, the appendix 7 is in one piece with the corresponding blade 4, and consists of a shaped portion of the blade 4, that is folded along a fold line 8.

The folds are made in such a way that each appendix 7 extends transversally to the corresponding blade 4.

In practice, when the blades 4 are mounted on the impeller assembly 1, the appendices 7 are parallel and coplanar to the second disk-like element 3.

Each appendix 7 has a side 9 resting on the second disk-like element 3, and extends inside of a circular crown coplanar to the second disk-like element 3; the circular crown is comprised within circumferences having diameters respectively coincident with those of the two disk-like elements 2 and 3.

It should be noted that the appendices 7 are placed substantially in correspondence of the areas subject to lesser axial thrust inside the aforesaid circular crown.

Each appendix 7 is also delimited by a shaped side that joins to the side coinciding with the fold line 8 and the side 9 which rests on the edge of the second disk-like element 3.

In the embodiment shown in FIGS. 1 and 2, the shaped side is constituted by a pair of segments 10*a* and 10*b*, consecutive and transverse between them.

In practice, the perimeter of each appendix 7 substantially has the shape of a circular crown sector.

However, as will appear evident to person skilled in the art, the aforementioned appendices may vary in size and in shape, without departing from the scope of the invention.

Figure 3:
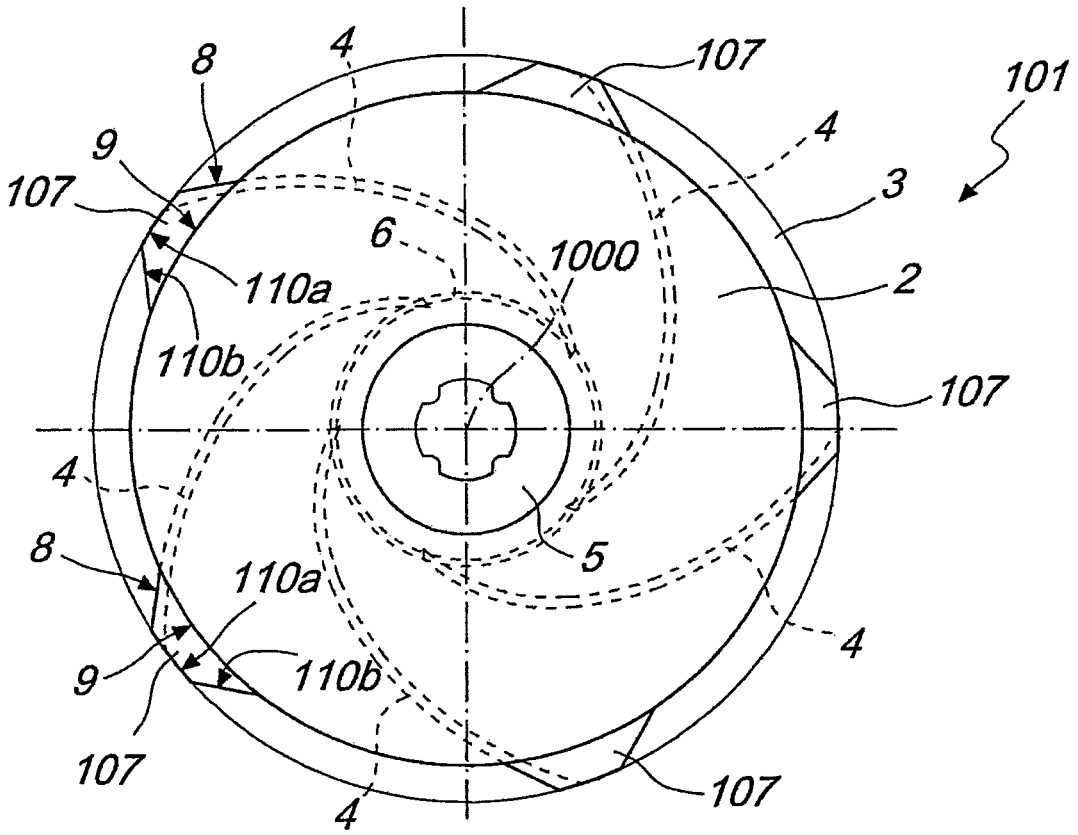
FIG. 3 is a front view of an impeller assembly according to a further aspect of the invention.

In fact, for example, FIG. 3 shows an impeller assembly, generally indicated with reference number 101, substantially similar to impeller assembly 1, but in which each appendix 107 is provided with a shaped side consisting of two segments 110*a* and 110*b*, that follow each other with a different angle.

It should also be noted that the shaped side may be discretized into a set of consecutive segments, differently positioned between them, which, at the limit, may also have the appearance of a curved portion.

Figure 4:
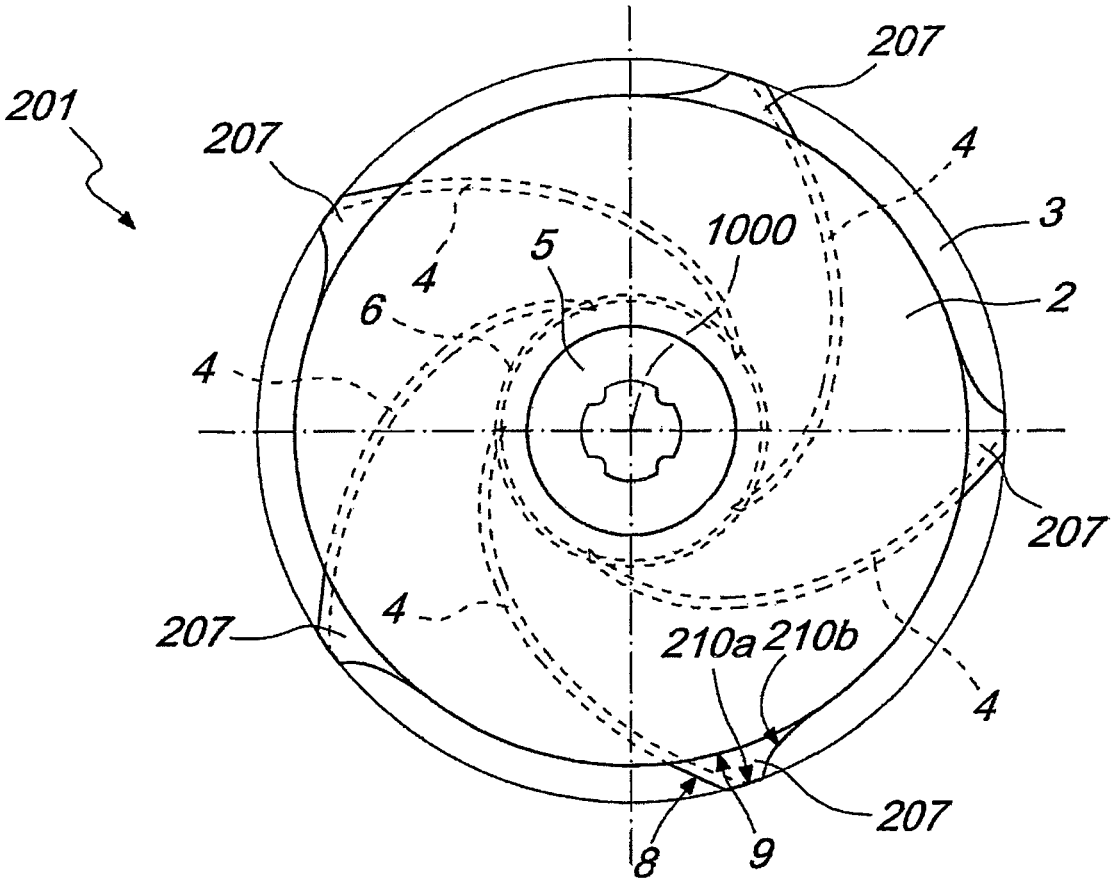
FIG. 4 is a front view of an impeller assembly according to still a further aspect of the invention.

FIG. 4, for example, shows an impeller assembly, generally indicated with reference number 201, substantially similar to impeller assemblies 1 and 101, where however the appendices 207 are equipped with a shaped side including a straight portion 210*a* and a curved portion 210*b*, with the concavity facing outside of the second disk-like element 3.

According to another embodiment, not illustrated in the figures, the shaped side includes a convex portion.

It is clear how the appendices may vary in a manner substantially equivalent in shape, size and proportions, without departing the scope of the invention.

In the embodiments shown in FIGS. 3 and 4, the elements corresponding to those already described with reference to the embodiment shown in FIGS. 1 and 2 have been identified with the same reference numbers.

The impeller assembly, according to the invention, can be manufactured using various techniques, using metallic materials such as, for example, steel, stainless steel and similar, or other materials having the required technical features.

Regarding the operation of the impeller assembly according to the present invention, experimental tests and a careful analysis of resulting data have revealed that the presence of these appendices implies a greater fluid dynamic performance and a good prevalence, given the same axial thrusts reduction.

In practice, it has been observed that the impeller assembly according to the invention fully achieves the intended aim, reducing the axial thrusts and at the same time ensuring maximum efficiency and prevalence.

This is achieved by having the appendices covering only the areas subject to lesser axial thrust, relative to the circular crown coplanar to the second disk-like element, and corresponding to circumferences with diameters respectively coincident with those of the two disk-like elements.

The one piece construction of the appendices and blades allows to use two disk-like elements which do not need to be installed in precise reciprocal angular positions.

This allows to simplify and speed up the manufacturing process of the impeller assembly according to the invention, making it clearly more advantageous also from a merely economical point of view.

In practice, materials employed, so long as compatible with the specific use, as well as the contingent size and shapes, can be any according to the requirements and the state of the art.

This application claims the priority of Italian Patent Application No. 102015000013754, filed on 4 May 2015, the subject matter of which is incorporated herein by reference.

The invention claimed is:

1. An impeller assembly for centrifugal pumps, comprising a first disk-like element, operatively arranged towards a coaxial inlet of a pump and facing a second disk-like element, the second disk-like element having an outer diameter smaller than an outer diameter of the first disk-like element, the second disk-like element being operatively arranged towards a delivery of said pump; said second disc-like element being rigidly connected to said first disk-like element through a set of angularly spaced blades, and being centrally provided with a hub configured to fasten to a drive shaft; wherein the set of angularly spaced blades comprise appendices, in flat sheet form, adjacent to said second disk-like element, each appendix is constituted by a folded portion of the corresponding blade; said folded portion extends transversally to the corresponding blade substantially in correspondence of a fold line at an edge of the corresponding blade, said appendices and said second disk-like element are coplanar.

2. An impeller assembly, according to claim 1, wherein each appendix is in one piece with the corresponding blade.

3. An impeller assembly, according to claim 1, wherein each appendix is delimited by at least a first side defined by said fold line, by at least a second side adjacent to a peripheral edge of said second disk-like element, and by at least a shaped side joined to said first and second sides.

4. An impeller assembly, according to claim 3, wherein said shaped side comprises at least two segments; said segments being consecutive and transverse to each other.

5. An impeller assembly, according to claim 3, wherein said shaped side comprises a succession of substantially straight segments.

6. An impeller assembly, according to claim 1, wherein the appendices are located radially outwardly of the second disk-like element.

7. A centrifugal pump comprising a substantially hollow body which accommodates at least one impeller assembly fastened to a transmission shaft which is rotatable about a rotation axis; said transmission shaft being rotated by a motor; the at least one impeller assembly comprising a first disk-like element, operatively arranged towards a coaxial inlet of said pump and facing a second disk-like element, the second disk-like element having an outer diameter smaller than an outer diameter of the first disk-like element, the second disk-like element being operatively arranged towards a delivery of said pump; said second disc-like element being rigidly connected to said first disk-like element through a set of angularly spaced blades, and being centrally provided with a hub configured to fasten to said transmission shaft; wherein the set of angularly spaced blades comprise appendices, in flat sheet form, adjacent to said second disk-like element, each appendix is constituted by a folded portion of the corresponding blade; said folded portion extends transversally to the corresponding blade substantially in correspondence of a fold line at an edge of the corresponding blade, said appendices and said second disk-like element are coplanar.

8. An impeller assembly, according to claim 7, wherein the appendices are located radially outwardly of the second disk-like element.

9. An impeller assembly for centrifugal pumps, comprising a first disk-like element, operatively arranged towards a coaxial inlet of a pump and facing a second disk-like element with a smaller diameter, operatively arranged towards a delivery of said pump; said second disc-like element being rigidly connected to said first disk-like element through a set of angularly spaced blades, and being centrally provided with a hub configured to fasten to a drive shaft; wherein the set of angularly spaced blades comprise appendices, in flat sheet form, adjacent to said second disk-like has been changed to element, wherein each appendix is constituted by a folded portion of the corresponding blade; said folded portion extends transversally to the corresponding blade substantially in correspondence of a fold line at an edge of the corresponding blade, wherein each appendix is delimited by at least a first side defined by said fold line, by at least a second side adjacent to a peripheral edge of said second disk-like element, and by at least a shaped side joined to said first and second sides, said shaped side comprises a curved portion having a concavity facing the outside of said second disk-like element.

10. An impeller assembly for centrifugal pumps, comprising a first disk-like element, operatively arranged towards a coaxial inlet of a pump and facing a second disk-like element with a smaller diameter, operatively arranged towards a delivery of said pump; said second disc-like element being rigidly connected to said first disk-like element through a set of angularly spaced blades, and being centrally provided with a hub configured to fasten to a drive shaft; wherein the set of angularly spaced blades comprise appendices, in flat sheet form, adjacent to said second disk-like element, wherein each appendix is constituted by a folded portion of the corresponding blade; said folded portion extends transversally to the corresponding blade substantially in correspondence of a fold line at an edge of the corresponding blade, wherein each appendix is delimited by at least a first side defined by said fold line, by at least a second side adjacent to a peripheral edge of said second disk-like element, and by at least a shaped side joined to said first and second sides, said shaped side comprises a curved portion having a convexity facing the outside of said second disk-like element.

* * * * *